US005236226A

United States Patent [19]

Sheffield

[11] Patent Number: 5,236,226

[45] Date of Patent: Aug. 17, 1993

[54] PORTFOLIO BINDER WITH ELASTIC RETAINING BANDS

[75] Inventor: Cheryl A. Sheffield, Springboro, Ohio

[73] Assignee: The Mead Corporation, Dayton, Ohio

[21] Appl. No.: 922,869

[22] Filed: Jul. 31, 1992

[51] Int. Cl.[5] ..... B42D 3/00

[52] U.S. Cl. ..... 281/48; 281/45; 281/31; 402/8; 402/73

[58] Field of Search ..... 281/31, 48, 45, 15.1, 281/29, 36; 402/8, 9, 18, 70, 73; 40/359

[56] References Cited

U.S. PATENT DOCUMENTS 730,727 6/1903 Wolff ..... 281/48
2,336,214 12/1943 Bartels ..... 281/48
4,519,629 5/1985 Podosek ..... 281/31 X
4,639,157 1/1987 Herzfeld ..... 281/31 X

*Primary Examiner*—Mark Rosenbaum
*Assistant Examiner*—Willmon Fridie, Jr.
*Attorney, Agent, or Firm*—Biebel & French

[57] ABSTRACT

A portfolio binder has a jacket including a front panel, and a rear panel foldably joined to the front panel along a jacket fold line. A front flap is foldably joined to the rear panel and secured with a fastening means to the front panel for maintaining the portfolio binder in a closed condition. A plurality of portfolios are individually retained in the jacket, each by an elastic band encircling the jacket fold line and extending between the front and rear covers of the associated portfolio and along a fold line joining the front and rear covers.

18 Claims, 6 Drawing Sheets

10
24
32
2
12
18
11
22
40
16

PORTFOLIO BINDER WITH ELASTIC RETAINING BANDS

BACKGROUND OF THE INVENTION

The present invention relates to a binder having a plurality of endless elastic bands for retaining a plurality of individual portfolios. More particularly the present invention relates to a portfolio binder having a jacket with a front panel and a rear panel foldably joined to the front panel along a fold line wherein an endless elastic band is positioned along the fold line encircling the jacket for retaining each portfolio therein.

In the past, there have been portfolio binders which have a plurality of portfolios or folders attached therein for containing loose-leaf papers. These portfolios use a bulky binding means to releasibly attach the portfolios to the portfolio binder.

Also, in the past, elastic bands have been used for retaining pamphlets and papers inside folders. An example is U.S. Pat. No. 2,308,770 which discloses a binder having elastic bands to hold periodicals in the binder. The elastic bands are attached to hooks which hook onto the binder and run along the fold line of the periodical, thereby holding the periodical in the binder. Another example is U.S. Pat. No. 4,480,407, which discloses elastic bands attached to pegs at each end of a sheet music binder for retaining sheets of music.

It is therefore seen that there is a need to provide an improved portfolio binder. Such a binder should have a means for removing the portfolios within the binder which does not provide a bulky fastening means at the fold line of the portfolio binder and further does not require pegs or hooks to attach the ends of the elastic bands to the binder.

SUMMARY OF THE INVENTION

This invention provides an improved portfolio binder which holds a plurality of portfolios therein. The portfolio binder uses an elastic band between the front and back covers of each of the respective portfolios to maintain the portfolio in the binder such that each portfolio can be easily removed or added. The endless elastic bands provide convenient means for fastening the plurality of portfolios to the portfolio binder.

The preferred embodiment of the invention provides a portfolio binder having a jacket including a front panel, and a rear panel foldably joined to the front panel along a jacket fold line. A plurality of portfolios are retained by the jacket. Each portfolio includes a front cover and a rear cover joined to the front cover along a portfolio fold line. A plurality of endless elastic bands, one for each of the portfolios, encircles the jacket fold line and the portfolio fold line, thereby securing the associated portfolio to the jacket.

The portfolio binder includes a front flap foldably joined to the rear panel opposite the jacket fold line. A fastening means attached to the front flap and the rear panel releasibly secures the front flap to the front panel. The fastening means holds the portfolio binder closed.

The front panel and the rear panel may further have an inside surface having panel pockets. These panel pockets are used to maintain loose-leaf papers therein.

In the preferred embodiment, the front flap has a plurality of longitudinal parallel scores allowing the front flap to be flexible, thereby accommodating various amounts of portfolios and papers within the jacket. Furthermore, the fastening means is a hook and loop fastening material attached to the front flap and the front panel of the portfolio binder.

A plurality of longitudinal parallel scores in the front and rear panels of the portfolio binder accommodate various quantities of portfolios and loose-leaf papers within the jacket. Furthermore, each portfolio retained in the portfolio binder has a front and a rear cover each having a pocket for retaining additional loose-leaf papers therein.

Accordingly, it is an object of the present invention to provide a portfolio binder which contains a plurality of portfolios therein.

Another object of the present invention is to provide a portfolio binder in which a number of portfolios can be retained therein and interchanged, each being retained by an individual retaining means in the form of an endless elastic band.

It is still another object of the present invention to provide a compact retaining means for the portfolios within the portfolio binder.

Other objects and advantages of the invention will be apparent from the following description, the accompanying drawings and the appended claims.

DETAILED DESCRIPTION

Figure 1:
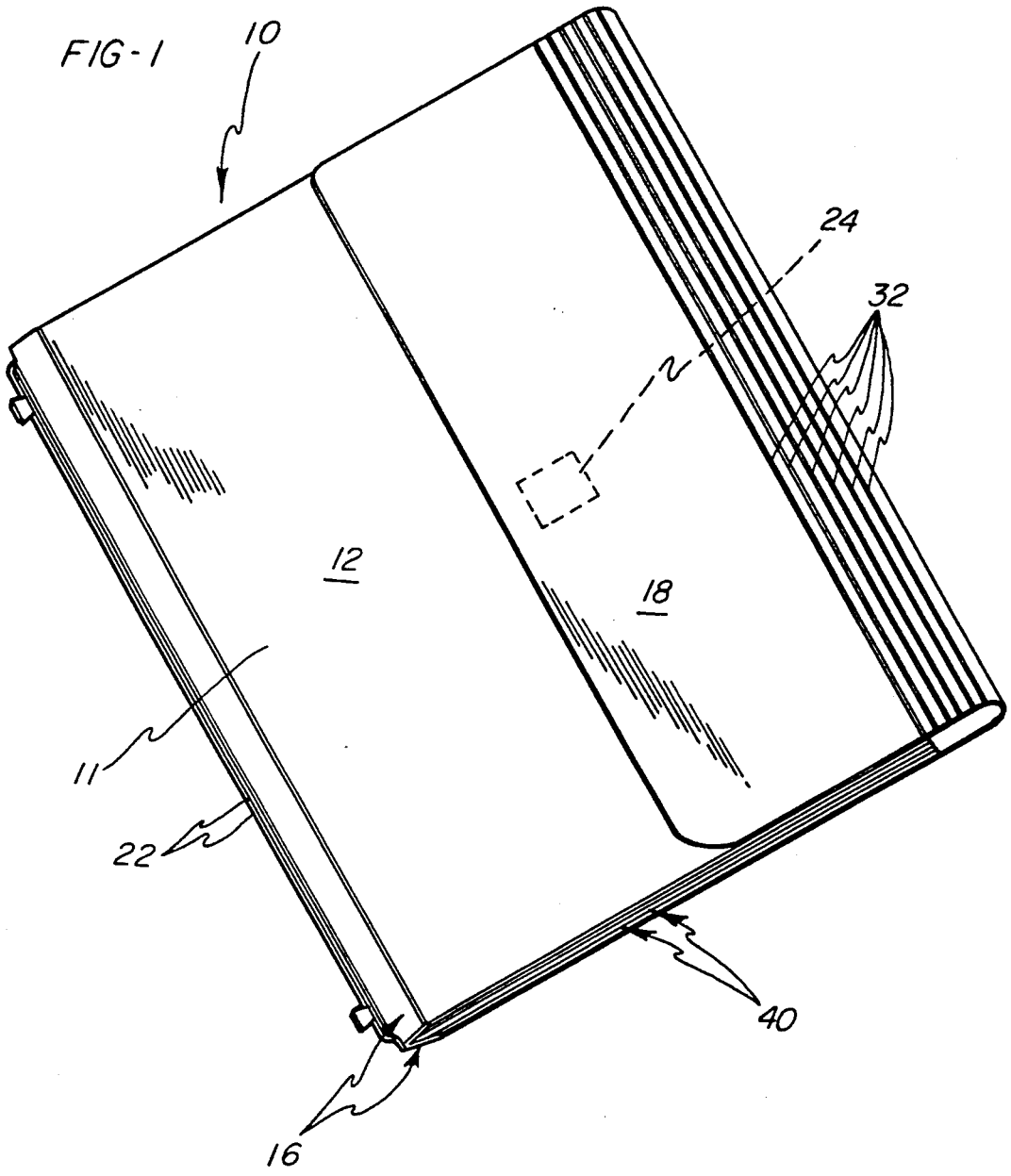
FIG. 1 is a perspective view of the portfolio binder in the closed position with a plurality of portfolios retained therein and the front flap fastened to the front cover.
Figure 2:
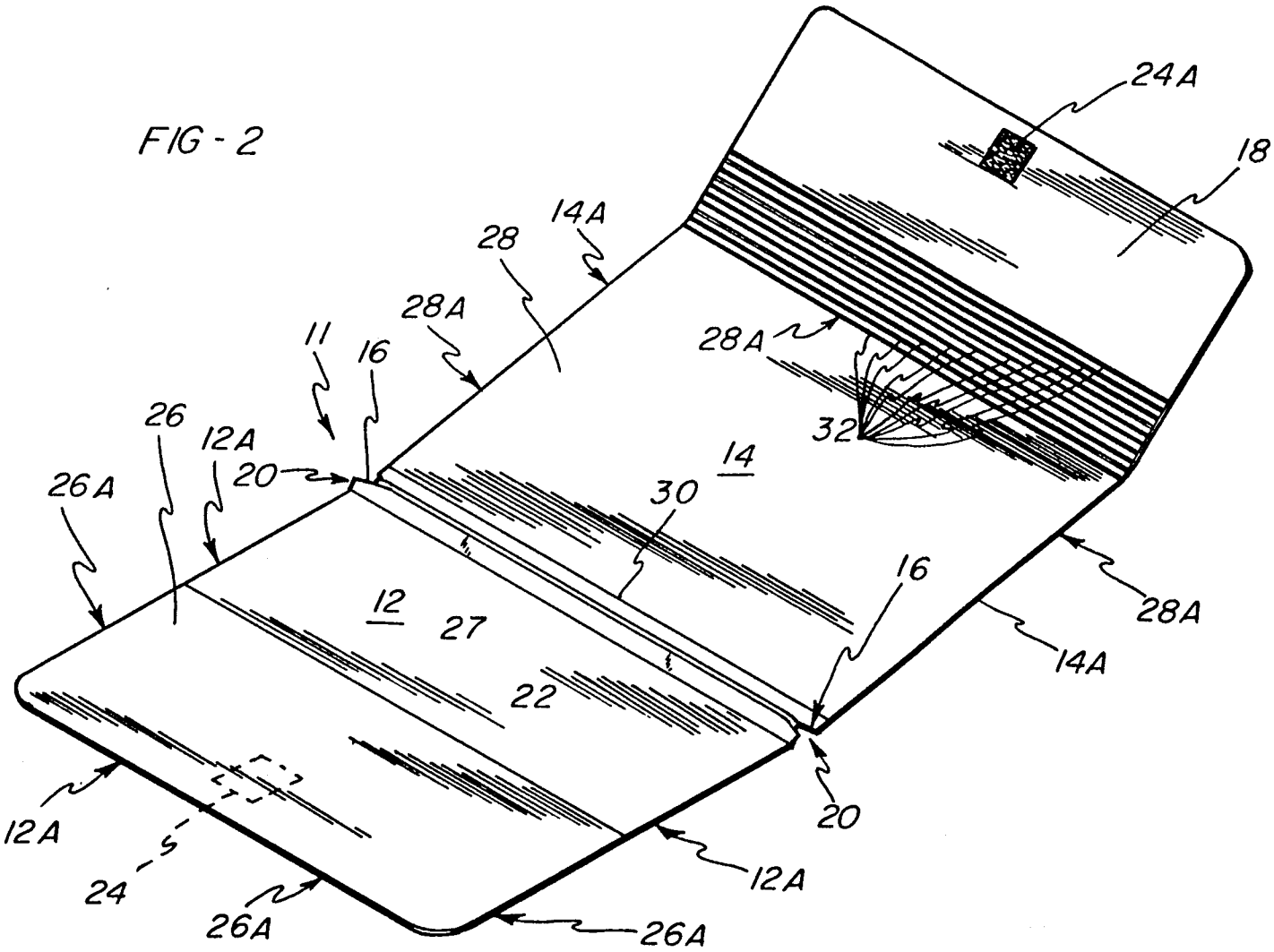
FIG. 2 is a perspective view showing a jacket for the portfolio binder.

A portfolio binder in accordance with the present invention is shown in FIGS. 1–6 as indicated by reference numeral 10. Referring to FIGS. 1 and 2, the portfolio binder includes a jacket 11 having a front panel 12, a rear panel 14 and a front flap 18. The rear panel 14 is foldably joined to the front panel 12 along a jacket fold line 16. The jacket fold line 16 may comprise either a single score or a plurality of scores. Using a plurality of scores for the jacket fold line 16 allows various amounts of loose-leaf papers or portfolios to be retained therein with the portfolio binder 10 accommodating for the various thicknesses. It is preferred that a pair of notches 20,20 be formed in opposite ends of jacket fold line 16, as illustrated in FIG. 2. These notches facilitate the seating of a set of elastic bands 22, as described in detail below.

The front flap 18 is foldably joined to the rear panel 14 along fold lines 32. These fold lines are longitudinal parallel scores in the front flap 18, allowing the front flap 18 to coincide with the jacket fold line 16 in accommodating various amounts and thicknesses of portfolios 40 and loose-leaf papers within the portfolio binder 10.

A fastening means 24, preferably hook and loop fastening material, is attached to the front flap 18 and the front panel 12. The fastening means 24 releasibly secures the front flap 18 to the front panel 12, as shown in FIG. 1.

An endless elastic band 22, one for each portfolio 40, encircles the jacket fold line 16. The endless elastic band 22 encircles the portfolio 40 at a portfolio fold line 52. This is discussed in more detail below.

The front panel 12 and rear panel 14 have lateral edges 12A and 14A respectively. A front panel pocket 26 is attached to the front panel 12. The front panel pocket 26 has outer edges 26A which are sealed to the outer edges 12A of the front panel 12. The front panel pocket 26 has a longitudinal opening 27 parallel to the jacket fold line 16 which extends along its inner edge the height of the front panel 12. The front pocket 26 provides a means for retaining additional loose-leaf papers between the front pocket 26 and front panel 12.

Figure 6:
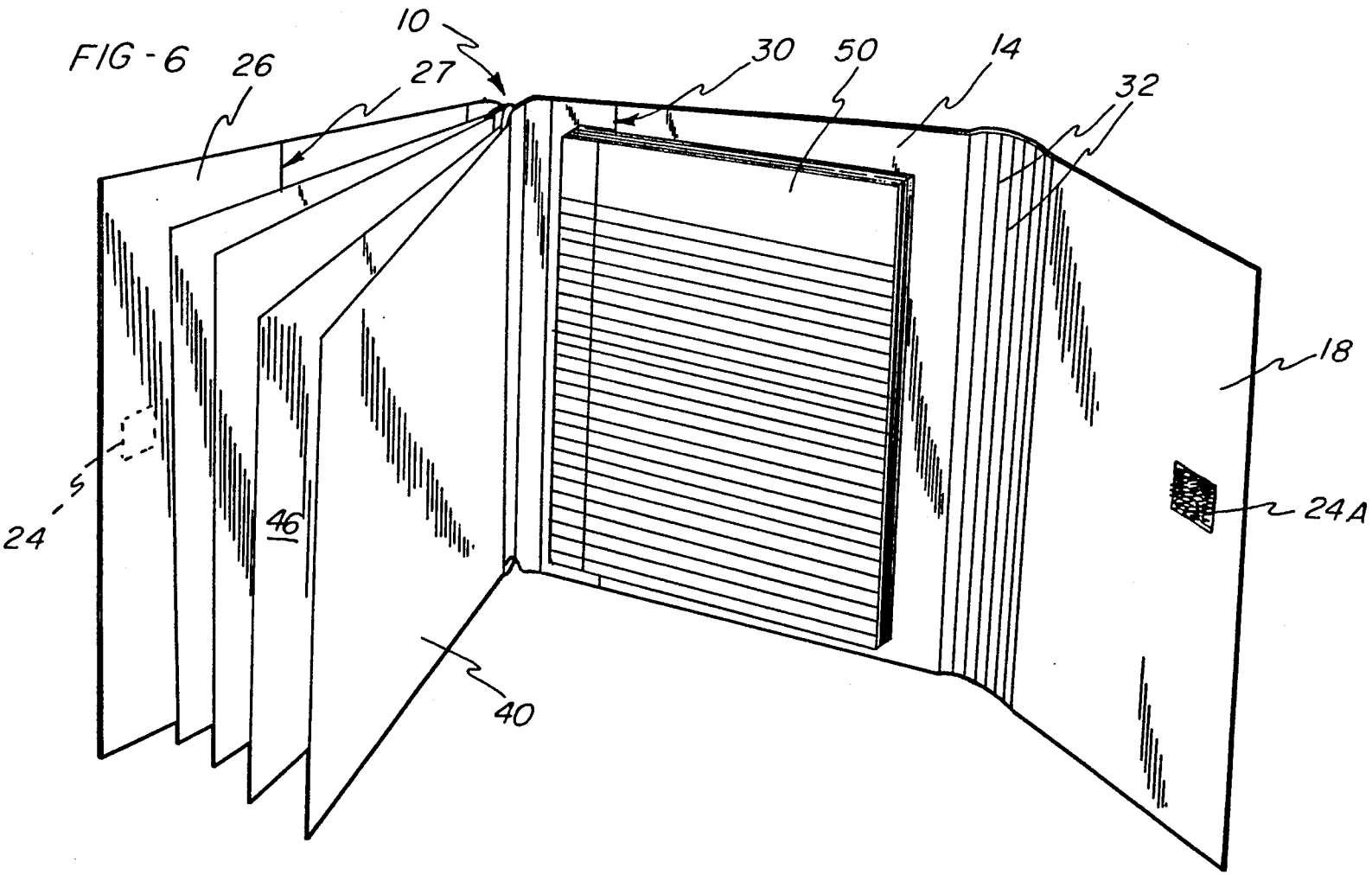
FIG. 6 is a perspective view of the portfolio binder including a tablet of paper retained therein.

A rear panel pocket 28 is attached to the rear panel 14 for retaining additional loose-leaf papers therein. The outer edges 28A of the rear panel pocket 28 are sealed to the outer edges 14A of the rear panel 14. The rear panel pocket 28 has a longitudinal opening 30 which extends along its inner edge the height of the rear panel 14 adjacent and parallel to the jacket fold line 16. The rear panel pocket 28 may hold additional loose leaf papers or a tablet of paper 50 by retaining the cardboard backing of the tablet, as shown in FIG. 6.

Figure 3:
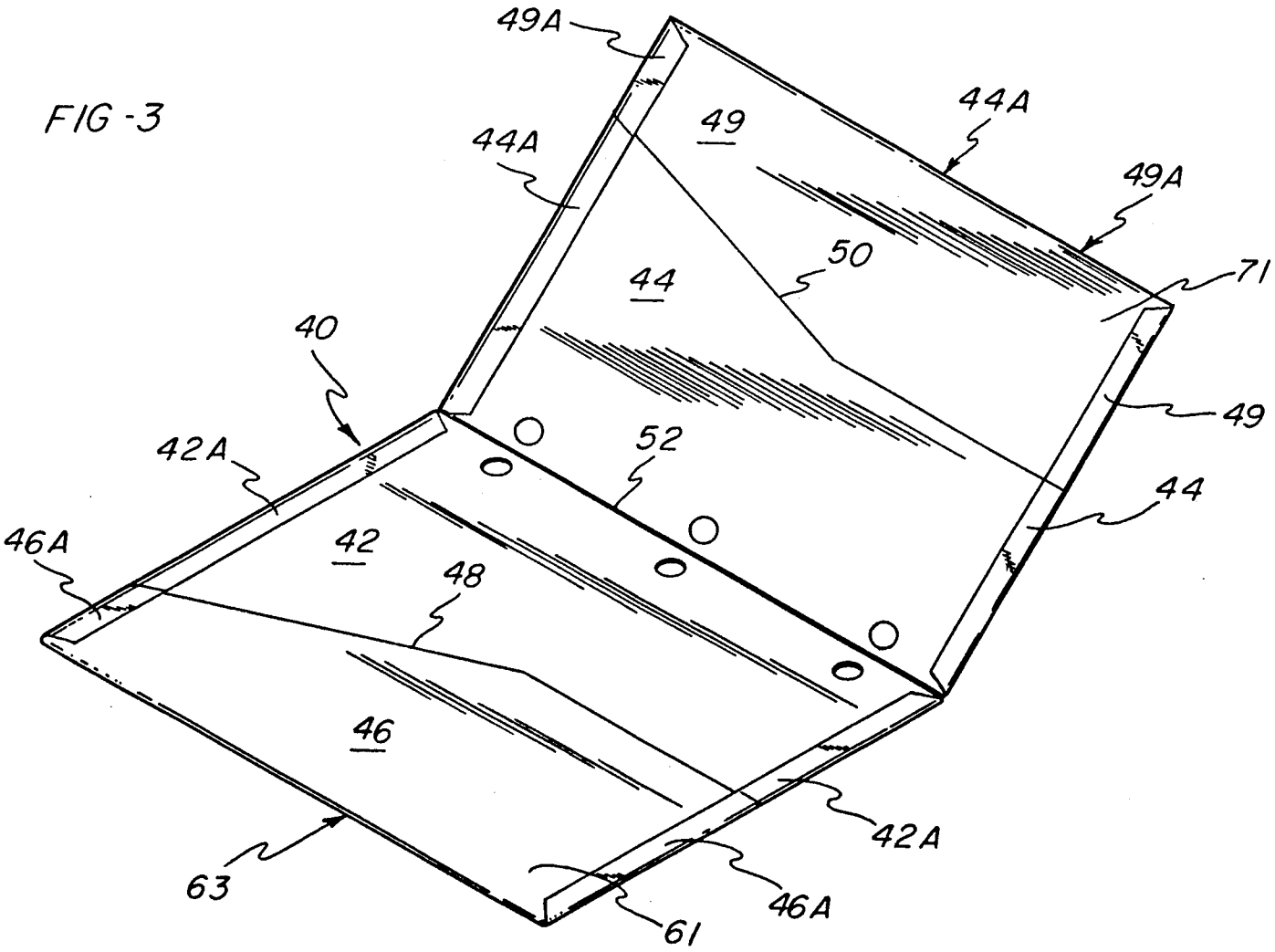
FIG. 3 is a perspective view of a portfolio for the portfolio binder.

Referring to FIG. 3, a portfolio 40 is shown having a front cover 42 and a rear cover 44. The rear cover 44 is foldably joined to the front cover 42 along a portfolio fold line 52. Front cover 42 has a pair of marginal flaps 42A, 42A and a second pair of marginal flaps 46A,46A. Flaps 42A,42A are sealed against the inside surface of front cover 42. Panel 61 is attached to cover 42 along their outer edges 63 and is folded against the inside surface of cover 42 to define a pocket 46. Flaps 46A,46A are sealed against panel 61 to close out the edges of pocket 46. Pocket 46 has a longitudinal opening 48 along its inner margin.

The rear cover 44 has a pair of marginal flaps 44A,44A, another pair of marginal flaps 49A,49A. Flaps 44A,44A are sealed against the inside surface of cover 44, while flaps 49A,49A and panel 71 cooperate to define a pocket 46 having an entrance 50.

Figure 4:
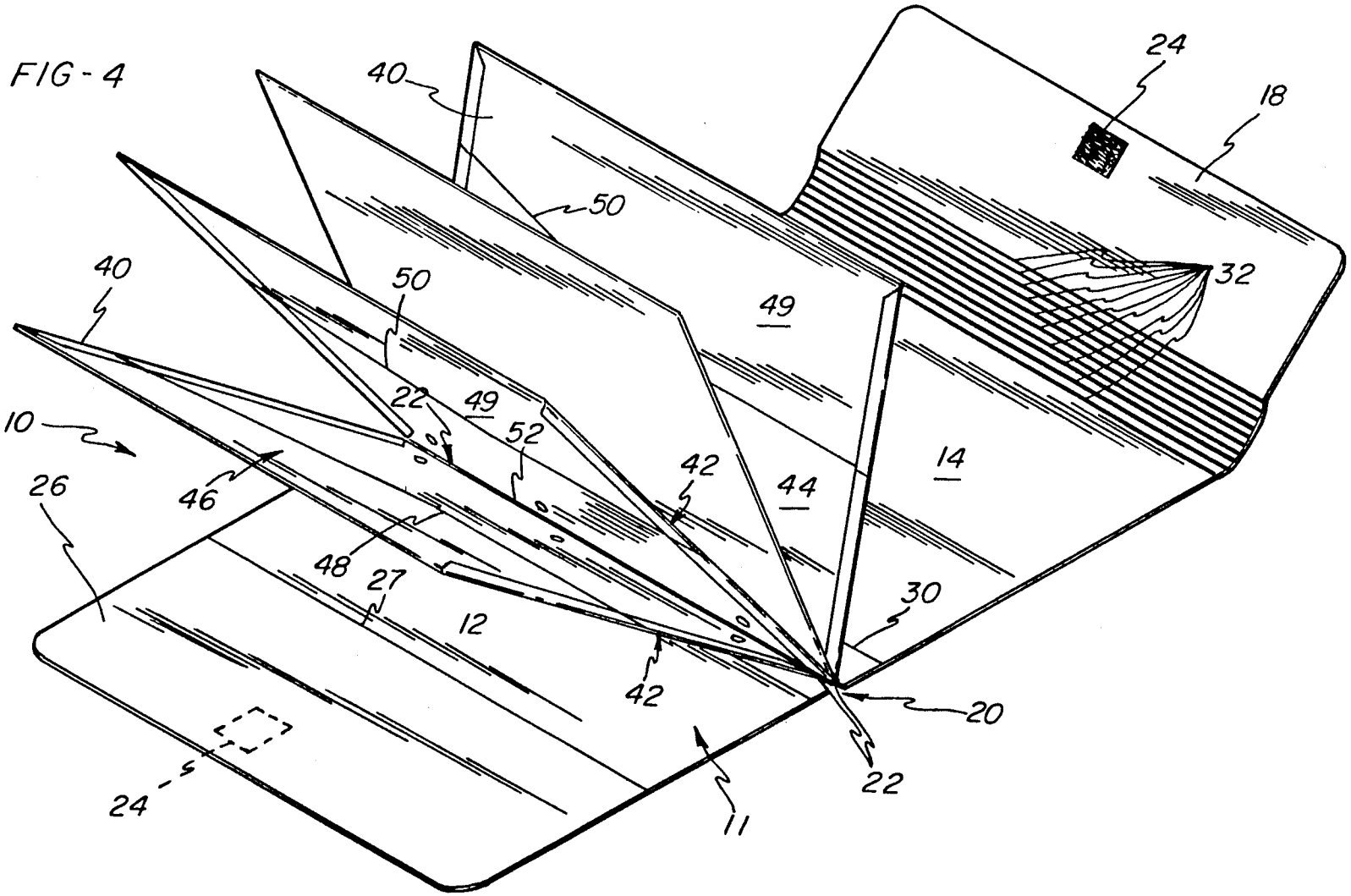
FIG. 4 is a perspective view of the portfolio binder with a plurality of portfolios held therein.
Figure 5:
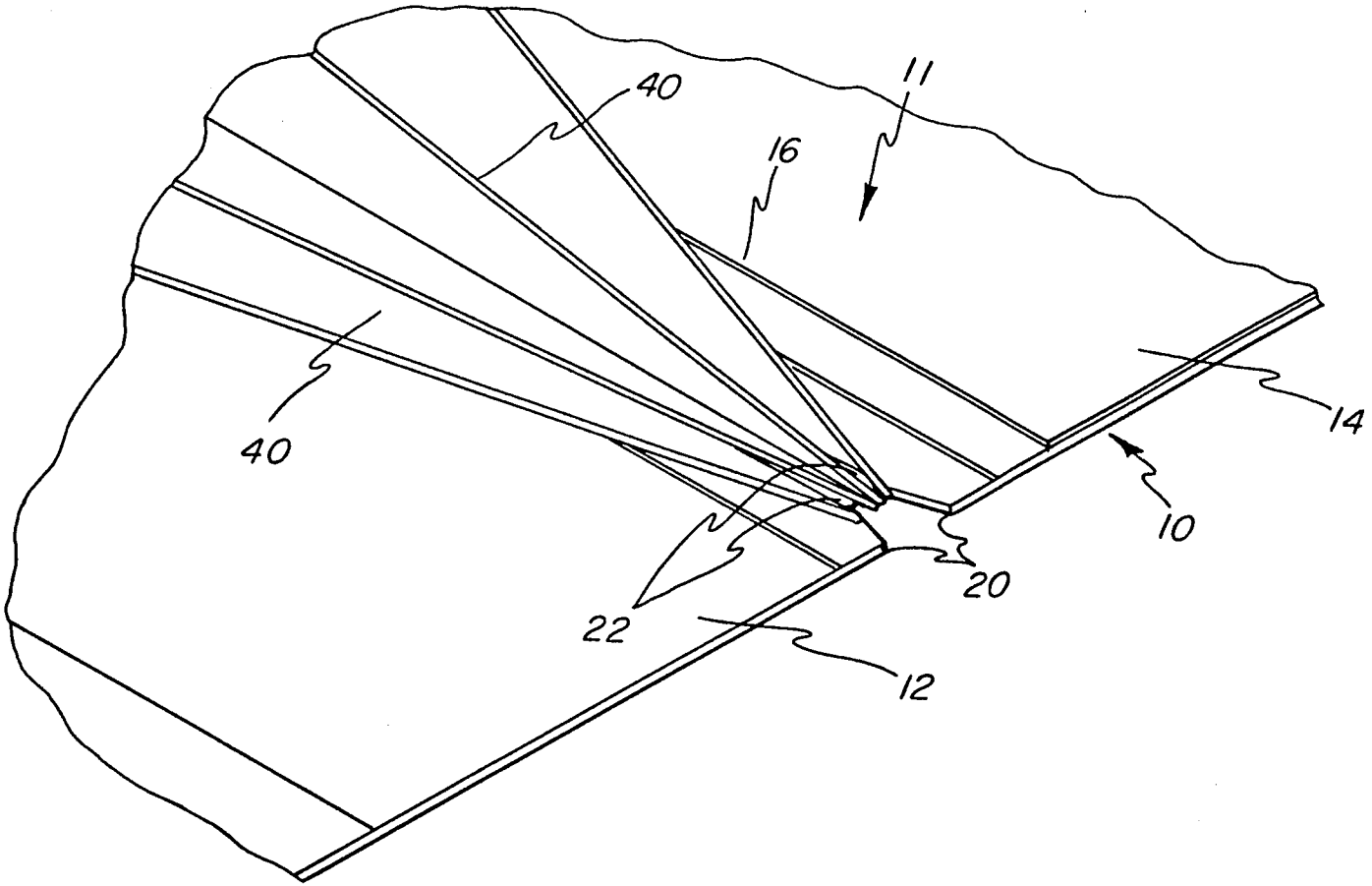
FIG. 5 is an enlarged perspective view of the jacket fold line of the portfolio binder.

Each portfolio 40 is retained in jacket 11 by an associated endless elastic band 20 positioned to encircle jacket fold line 16. Elastic bands 20 encircle their associated portfolios at fold lines 52, as illustrated in FIG. 4. Notches 20 prevent portfolios 40 and elastic bands 22 from sliding along front panel 12 or rear panel 14, as best illustrated in FIG. 5.

Referring to FIG. 1, front flap 18 is secured to the front cover 12 by hook and loop fastening means 24 and accommodates various amounts of portfolios 40 therein. Portfolio binder 10 is opened by pulling front flap 18 away from the front panel 12, thereby releasing the hook and loop fastener patches 24, 24A. Upon opening, portfolio binder 10 appears as shown in FIGS. 4 and 6.

To remove a portfolio 40 from the portfolio binder 10, the elastic band 22 for that portfolio is pulled out of the notches 20. The portfolio 40 is then slid down the front panel 12, with the elastic band 22 still surrounding the portfolio fold line 52 until the portfolio 40 is slid off the portfolio binder 10. This maintains the elastic band with each portfolio 40.

Alternatively, if it is desired to maintain the elastic band 22 on the portfolio binder 10, the portfolio 40 is pulled out from under the elastic band 22 by opening the portfolio 40 and sliding the portfolio 40 such that the elastic band 22 slides along the front cover 42 or the rear cover 44 of the portfolio 40. The portfolio 40 is slid until it moves out from under its elastic band 22. This allows the elastic band 22 to be retained by the portfolio binder 10 in notches 20 instead of in the portfolio 40 itself.

If additional portfolios 40 are to be added to the portfolio binder 10, the reverse of the above is performed. If the elastic bands 22 are retained by the portfolio binder 10 then the portfolio's front 42 or rear 44 cover is slid underneath the elastic band 22 until the elastic band coincides with the portfolio fold line 52.

Alternatively, if the elastic bands 22 are retained by the portfolio 40, then the elastic band 22 is placed around the front panel 12 of the portfolio binder 10, and the portfolio 40 is slid up the front cover until the elastic band 22 slides into notches 20 of the portfolio binder 10. The elastic band 22 thereby encircles the jacket fold line 16 of the portfolio binder 10 and the portfolio fold line 42 of the portfolio 40.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A portfolio binder comprising:

a jacket including a front panel, a rear panel foldably joined to said front panel along a jacket fold line, a front flap foldably joined to said rear panel opposite said jacket fold line, and fastening means for releasibly securing said front flap to said front panel;

at least one portfolio retained by said jacket, each such portfolio including a front cover and a rear cover joined to said front cover along a portfolio fold line;

an individual and separate endless elastic band for each such portfolio, each said elastic band encircling said jacket fold line and the portfolio fold line of its associated portfolio, thereby securing said associated portfolio within said jacket; and means releasibly retaining each said elastic band in encircling relation with said jacket along said jacket fold line.

2. A portfolio binder as defined in claim 19 wherein said front panel further includes an inside surface having a front panel pocket formed thereon by a panel secured thereto along the side and outer edges thereof to provide said pocket with an opening facing said jacket fold line.

3. A portfolio binder as defined in claim 20 wherein said front panel pocket opening extends the height of said front panel.

4. A portfolio binder as defined in claim 1 wherein said rear panel includes an inside surface having a rear panel pocket for retaining papers therein which is formed on said rear panel by a panel secured thereto along the side and outer edges thereof to provide said pocket with an opening facing said jacket fold line.

5. A portfolio binder as defined in claim 4 wherein said rear panel pocket opening extends the height of said rear panel.

6. A portfolio binder as defined in claim 1 wherein said fastening means comprises hook and loop fastening material.

7. A portfolio binder as defined in claim 1 wherein said elastic band retaining means comprise notches at the ends of said jacket fold line for retaining each said elastic band in encircling relationship about said jacket fold line.

8. A portfolio binder as defined in claim 7 wherein said front and rear panels are joined along a plurality of parallel fold lines for accommodating various amounts of portfolios and papers within said jacket.

9. A portfolio binder as defined in claim 8 wherein said front flap is joined to said rear panel along a plurality of longitudinal parallel fold lines thereby accommodating various amounts of portfolios and papers within said jacket.

10. A portfolio binder comprising:

a jacket including a front panel having inside and outside surfaces, a rear panel foldably joined to said front panel along a jacket fold line and having an inside surface, a front flap having an inside surface and foldably joined to said rear panel opposite said jacket fold line, hook and loop fastening material attached to said inside surface of said front flap and said outside surface of said front panel for releasibly securing said front flap to said front panel, a plurality of portfolios retained by said jacket, each of said portfolios including a front cover having an inside surface and a rear cover having an inside surface, said rear cover being foldably joined to said front cover along a portfolio fold line, an individual and separate endless elastic band for each of said portfolios, each of said elastic bands encircling said jacket fold line and the portfolio fold line of its associated portfolio and thereby securing said associated portfolio within said jacket, and said jacket having a notch at each of end of said jacket fold line for releasibly retaining said endless elastic bands on said jacket along said jacket fold line.

11. A portfolio binder as defined in claim 10 wherein said inside surface of said front panel is provided with a front panel pocket formed thereon by a panel secured thereto along the side and outer edges thereof to provide said pocket with an opening facing said jacket fold line.

12. A portfolio binder as defined in claim 10 wherein said front panel opening extends the height of said front panel.

13. A portfolio binder as defined in claim 10 wherein said inside surface of said rear panel is provided with a rear panel pocket for retaining papers therein which is formed on said rear panel by a panel secured thereto along the side and outer edges thereof to provide said pocket with an opening facing said jacket fold line.

14. A portfolio binder as defined in claim 13 wherein said rear panel pocket opening extends the height of said rear panel.

15. A portfolio binder as defined in claim 10 wherein said front flap is joined to said rear panel along a plurality of parallel fold lines for accommodating various thicknesses of portfolios and papers within said jacket.

16. A portfolio binder as defined in claim 10 wherein said front and rear panels of said jacket are joined along a plurality of parallel fold lines for accommodating various thicknesses of portfolios and papers within said jacket.

17. A portfolio binder as defined in claim 10 wherein said inside surface of each said portfolio front cover is provided with a pocket for retaining papers therein, each of said pockets being formed by a panel secured to the side and outer edges of the respective said surface to provide said pocket with an opening facing said jacket fold line.

18. The portfolio binder as defined in claim 10 wherein said inside surfaces of each said portfolio rear cover is provided with a pocket for retaining papers therein which is formed on said rear panel by a panel secured thereto along the side and outer edges thereof to provide said pocket with an opening facing said jacket fold line.

* * * * *

UNITED STATES PATENT AND TRADEMARK OFFICE

CERTIFICATE OF CORRECTION

PATENT NO. : 5,236,226

DATED : August 17, 1993

INVENTOR(S) : Cheryl A. Sheffield

It is certified that error appears in the above-identified patent and that said Letters Patent is hereby corrected as shown below:

Column 4, Claim 2, line 48, "claim 19" should read --claim 1--.

Column 4, Claim 3, line 54, "claim 20" should read --claim 2--.

Column 5, Claim 10, line 39, delete first occurrence "of".

Signed and Sealed this

Fifth Day of April, 1994

Bruce Lehman

*Attest:*

BRUCE LEHMAN

*Attesting Officer*

*Commissioner of Patents and Trademarks*